US007918319B2

(12) United States Patent
Hashiguchi

(10) Patent No.: US 7,918,319 B2
(45) Date of Patent: Apr. 5, 2011

(54) ELEVATOR APPARATUS

(75) Inventor: Naoki Hashiguchi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 836 days.

(21) Appl. No.: 11/814,862

(22) PCT Filed: May 1, 2006

(86) PCT No.: PCT/JP2006/309090
§ 371 (c)(1),
(2), (4) Date: Jul. 26, 2007

(87) PCT Pub. No.: WO2007/129385
PCT Pub. Date: Nov. 15, 2007

(65) Prior Publication Data

US 2009/0301818 A1 Dec. 10, 2009

(51) Int. Cl.
*B66B 9/00* (2006.01)

(52) U.S. Cl. ..... 187/249

(58) Field of Classification Search ..... 187/249
See application file for complete search history.

(56) References Cited

FOREIGN PATENT DOCUMENTS

| | | | |
|---|---|---|---|
| EP | 1 481 935 | | 12/2004 |
| JP | S57-22875 | | 5/1982 |
| JP | 2000-1270 | A * | 1/2000 |
| JP | 2002-351556 | | 12/2000 |
| JP | 2002 80183 | | 3/2002 |
| JP | 2002-173279 | | 6/2002 |
| JP | 2003-146561 | A * | 5/2003 |
| JP | 2004-155519 | A * | 6/2004 |
| WO | 2004/046009 | A * | 6/2004 |

OTHER PUBLICATIONS

U.S. Appl. No. 11/814,327, filed Jul. 19, 2007, Hashiguchi.

* cited by examiner

*Primary Examiner* — Thomas J. Brahan
(74) *Attorney, Agent, or Firm* — Oblon, Spivak, McClelland, Maier & Neustadt, L.L.P.

(57) ABSTRACT

In an elevator apparatus, a second car is disposed below a first car. The second car is suspended within a hoistway by a second suspension body and a third suspension body to be raised/lowered by a second hoisting machine. The second suspension body has a second car end connected to the second car on a first lateral surface side thereof. The third suspension body has a third car end connected to the second car on a second lateral surface side thereof. A looping angle adjusting pulley for increasing the looping angle of the second suspension body with respect to a second drive sheave is disposed in an upper portion of the hoistway.

7 Claims, 9 Drawing Sheets

ELEVATOR APPARATUS

TECHNICAL FIELD

The present invention relates to an elevator apparatus of such a type that a plurality of cars are raised/lowered independently of one another within a common hoistway, namely, of a so-called one-shaft multi-car type.

BACKGROUND ART

In a conventional elevator apparatus of a one-shaft multi-car type, both an upper car and a lower car are suspended within a common hoistway according to a 1:1 roping arrangement. A main rope for the lower car is divided into halves and disposed so as to extend past both sides of the upper car, respectively. In addition, a hoisting machine for the upper car, a deflector pulley for the upper car, a hoisting machine for the lower car, a first deflector pulley for the lower car, and a second deflector pulley for the lower car are disposed in an upper portion of the hoistway (e.g., see Patent Document 1).

Patent Document 1: JP 2000-351556 A

DISCLOSURE OF THE INVENTION

Problem to be Solved by the Invention

In the conventional elevator apparatus constructed as described above, each of the hoisting machines and a corresponding one of the deflector pulleys are disposed vertically apart from each other by a great distance so as to secure a looping angle of a corresponding one of main ropes with respect to a drive sheave. Thus, the vertical space for installing the hoisting machines and the deflector pulleys is enlarged.

The present invention has been made to solve the above-mentioned problem, and it is therefore an object of the present invention to provide an elevator apparatus allowing a plurality of hoisting machines and a plurality of groups of pulleys to be disposed efficiently in an upper portion of a hoistway so as to achieve a reduction in installation space.

Means for Solving the Problems

An elevator apparatus according to the present invention includes: a first hoisting machine having a first drive sheave and disposed in an upper portion of a hoistway such that a rotary shaft of the first drive sheave extends horizontally; a first car and a first counterweight that are raised/lowered within the hoistway by the first hoisting machine; a first suspension body having a first car end connected to an upper portion of the first car and a first counterweight end connected to the first counterweight, and looped around the first drive sheave; a second hoisting machine having a second drive sheave and disposed in the upper portion of the hoistway such that a rotary shaft of the second drive sheave extends horizontally; a second car, disposed below the first car and having a first lateral surface and a second lateral surface that face each other, for being raised/lowered within the hoistway by the second hoisting machine; a second counterweight that is raised/lowered within the hoistway by the second hoisting machine; a second suspension body having a second car end connected to the second car on the first lateral surface side thereof and a second counterweight end connected to the second counterweight, and looped around the second drive sheave; a third suspension body having a third car end connected to the second car on the second lateral surface side thereof and a third counterweight end connected to the second counterweight, and looped around the second drive sheave; a first deflector pulley disposed in the upper portion of the hoistway and having the first suspension body looped therearound; and a second deflector pulley disposed in the upper portion of the hoistway and having the second suspension body looped therearound, in which the hoistway has, disposed in the upper portion thereof, a looping angle adjusting pulley having the second suspension body looped therearound between the second drive sheave and the second deflector pulley to increase a looping angle of the second suspension body with respect to the second drive sheave.

Further, an elevator apparatus according to the present invention includes: a first hoisting machine having a first drive sheave and disposed in an upper portion of a hoistway; a first car and a first counterweight that are raised/lowered within the hoistway by the first hoisting machine; a first suspension body having a first car end connected to an upper portion of the first car and a first counterweight end connected to the first counterweight, and looped around the first drive sheave; a second hoisting machine having a second drive sheave and disposed in the upper portion of the hoistway; a second car, disposed below the first car and having a first lateral surface and a second lateral surface that face each other, for being raised/lowered within the hoistway by the second hoisting machine; a second counterweight that is raised/lowered within the hoistway by the second hoisting machine; a second suspension body having a second car end connected to the second car on the first lateral surface side thereof and a second counterweight end connected to the second counterweight, and looped around the second drive sheave; and a third suspension body having a third car end connected to the second car on the second lateral surface side thereof and a third counterweight end connected to the second counterweight, and looped around the second drive sheave, in which: the first hoisting machine and the second hoisting machine are disposed above the first car and the second car; the first car has a first car suspending portion, to which the first car end is connected, provided on an upper portion thereof, the first counterweight has a first counterweight suspending portion, to which the first counterweight end is connected, provided on an upper portion thereof; the second car is provided with a second car suspending portion to which the second car end is connected, and a third car suspending portion to which the third car end is connected; the second counterweight has a second counterweight suspending portion, to which the second counterweight end and the third counterweight end are connected, provided on an upper portion thereof; and the hoistway has, disposed in the upper portion thereof, a first car-side deflector pulley for leading the first suspension body to the first car suspending portion, a first counterweight-side deflector pulley for leading the first suspension body to the first counterweight suspending portion, a second car-side deflector pulley for leading the second suspension body to the second car suspending portion, a third car-side deflector pulley for leading the third suspension body to the third car suspending portion, a second counterweight-side deflector pulley for leading the second suspension body and the third suspension body to the second counterweight suspending portion, and a turning pulley for reversing an orientation of the second suspension body drawn out from the second drive sheave and leading the second suspension body to the second car-side deflector pulley.

BEST MODES FOR CARRYING OUT THE INVENTION

Preferred embodiments of the present invention will be described hereinafter with reference to the drawings.

Embodiment 1

Figure 1:
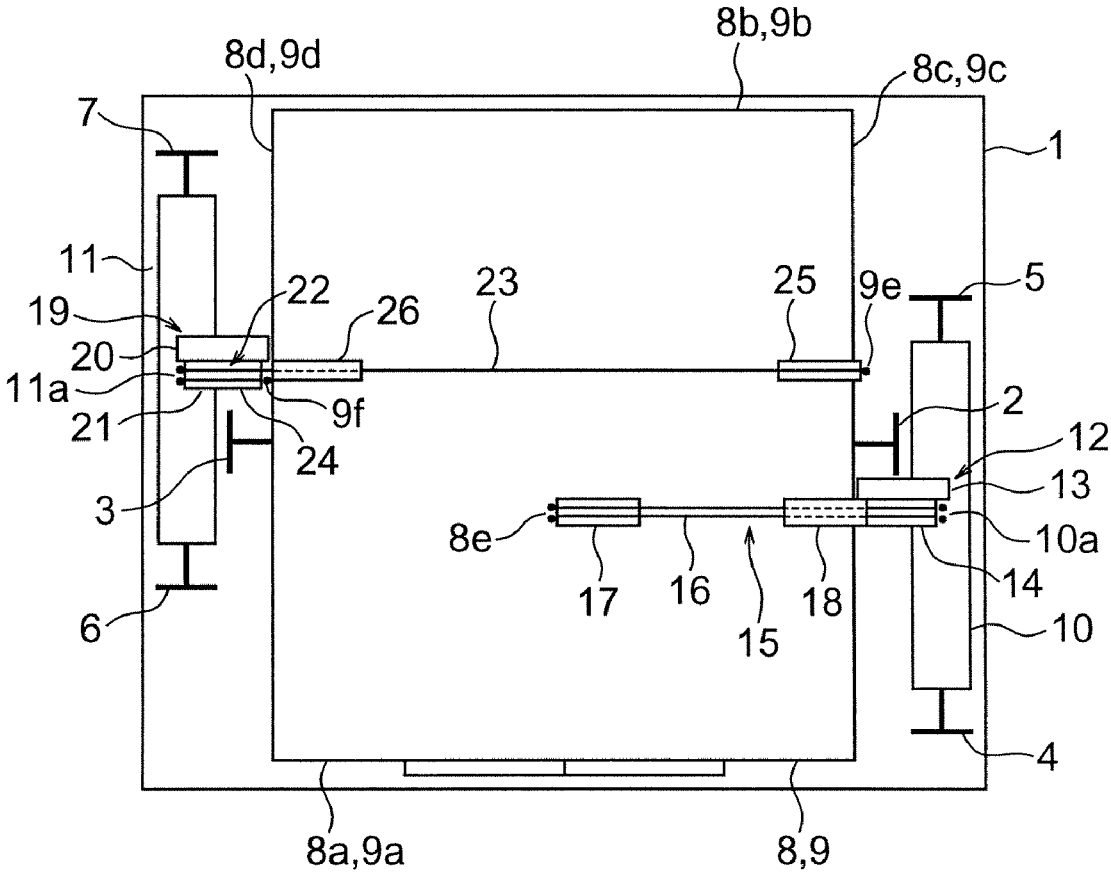
FIG. 1 is a schematic plan view showing an elevator apparatus according to Embodiment 1 of the present invention.
Figure 2:
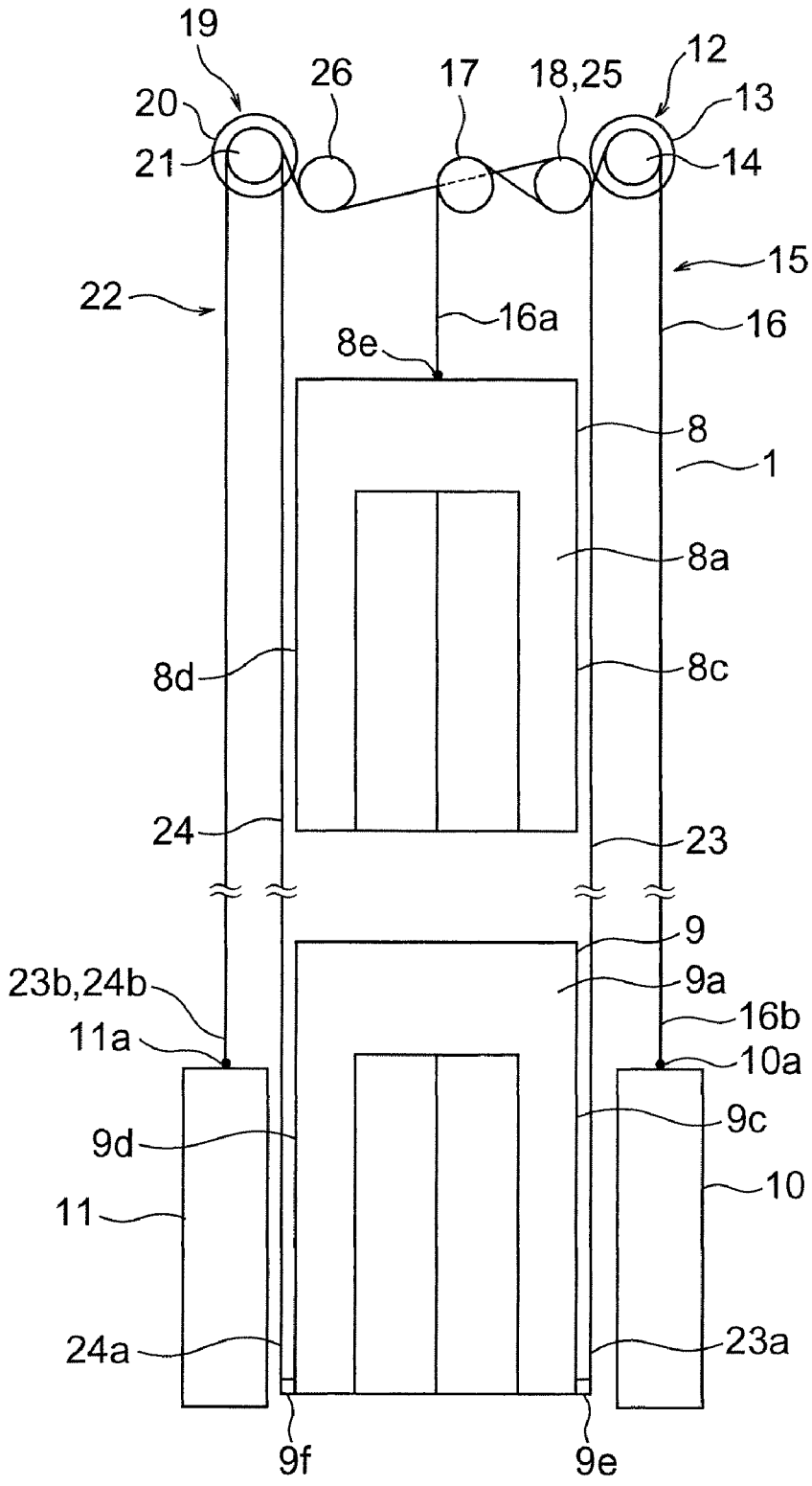
FIG. 2 is a front view showing an essential part of FIG. 1.

FIG. 1 is a schematic plan view showing an elevator apparatus (elevator without machine room) according to Embodiment 1 of the present invention. FIG. 2 is a front view showing an essential part of FIG. 1. A pair of car guide rails 2 and 3, a pair of first counterweight guide rails 4 and 5, and a pair of second counterweight guide rails 6 and 7 are installed within a hoistway 1. Those guide rails 2 to 7 are not illustrated in FIG. 2.

A first car (upper car) 8 and a second car (lower car) 9 are guided by the car guide rails 2 and 3 to be raised/lowered within the hoistway 1. A first counterweight 10 is guided by the first counterweight guide rails 4 and 5 to be raised/lowered within the hoistway 1. A second counterweight 11 is guided by the second counterweight guide rails 6 and 7 to be raised/lowered within the hoistway 1.

The first car 8 is disposed above the second car 9. The second car 9 is disposed below the first car 8. The first car 8 has a front surface 8*a* provided with a car doorway, a back surface 8*b* facing the front surface 8*a*, a first lateral surface 8*c*, and a second lateral surface 8*d* facing the first lateral surface 8*c*, and the second car 9 has a front surface 9*a* provided with a car doorway, a back surface 9*b* facing the front surface 9*a*, a first lateral surface 9*c*, and a second lateral surface 9*d* facing the first lateral surface 9*c*.

A first car suspending portion 8*e* is provided on an upper portion of the first car 8. The first car suspending portion 8*e* is disposed in the vicinity of the center of gravity of the first car 8 on a vertical projection plane.

A second car suspending portion 9*e* is provided at a lower end of the first lateral surface 9*c* of the second car 9. A third car suspending portion 9*f* is provided at a lower end of the second lateral surface 9*d* of the second car 9. The second car suspending portion 9*e* and the third car suspending portion 9*f* are disposed such that a line connecting the second car suspending portion 9*e* and the third car suspending portion 9*f* to each other extends past the vicinity of the center of gravity of the second car 9 on the vertical projection plane.

A first counterweight suspending portion 10*a* is provided on an upper portion of the first counterweight 10. A second counterweight suspending portion 11*a* is provided on an upper portion of the second counterweight 11. The first counterweight suspending portion 10*a* and the second counterweight suspending portion 11*a* are provided at width centers of the first counterweight 10 and the second counterweight 11, respectively.

The first counterweight 10 is disposed beside the cars 8 and 9 so as to face the first lateral surfaces 8*c* and 9*c* when being located at the same height as the cars 8 and 9, respectively. The second counterweight 11 is disposed beside the cars 8 and 9 on the other side of the first counterweight 10 so as to face the second lateral surfaces 8*d* and 9*d* when being located at the same height as the cars 8 and 9, respectively. The first counterweight 10 is disposed offset from longitudinal centers of the first car 8 and the second car 9, and the second counterweight 11 is disposed offset from the longitudinal centers of the first car 8 and the second car 9 on the other side of the first counterweight 10. That is, the first counterweight 10 and the second counterweight 11 are disposed substantially symmetrically around each of the centers of gravity of the cars 8 and 9 on the vertical projection plane.

The first car 8 and the first counterweight 10 are raised/lowered by a first hoisting machine 12 disposed in an upper portion within the hoistway 1. The first hoisting machine 12 has a first hoisting machine body 13 including a motor and a brake, and a first drive sheave 14 that is rotated by the first hoisting machine body 13. A low-profile hoisting machine that is smaller in dimension in an axial direction thereof than in a direction perpendicular to the axial direction is employed as the first hoisting machine 12.

The first hoisting machine 12 is disposed such that a rotary shaft of the first drive sheave 14 extends horizontally and parallel to a longitudinal direction (depth direction) of the cars 8 and 9. In addition, the first hoisting machine 12 is disposed above the first counterweight 10 so as to overlap with the first counterweight 10 on the vertical projection plane.

A first suspension body group 15 is looped around the first drive sheave 14. The first suspension body group 15 includes a plurality of first suspension bodies 16. Each of the first suspension bodies 16 has a first car end 16*a* connected to the first car suspending portion 8*e*, and a first counterweight end 16*b* connected to the first counterweight suspending portion 10*a*. That is, the first car 8 and the first counterweight 10 are suspended within the hoistway 1 by the first suspension body group 15 according to a 1:1 roping arrangement.

A first deflector pulley 17 for leading the first suspension bodies 16 to the first car suspending portion 8*e*, and a first looping angle adjusting pulley 18 for increasing the looping angles of the first suspension bodies 16 with respect to the first drive sheave 14 are disposed in the upper portion within the hoistway 1. The first looping angle adjusting pulley 18 is disposed between the first drive sheave 14 and the first deflector pulley 17. The first deflector pulley 17 and the first looping angle adjusting pulley 18 are disposed such that rotary shafts thereof extend parallel to the rotary shaft of the first drive sheave 14.

The second car 9 and the second counterweight 11 are raised/lowered by a second hoisting machine 19 disposed in the upper portion within the hoistway 1. The second hoisting machine 19 has a second hoisting machine body 20 including a motor and a brake, and a second drive sheave 21 that is rotated by the second hoisting machine body 20. A low-profile hoisting machine that is smaller in dimension in an axial direction thereof than in a direction perpendicular to the axial direction is employed as the second hoisting machine 19.

The second hoisting machine 19 is disposed such that a rotary shaft of the second drive sheave 21 extends horizontally and parallel to the longitudinal direction of the cars 8 and 9. In addition, the second hoisting machine 19 is disposed above the second counterweight 11 so as to overlap with the second counterweight 11 on the vertical projection plane.

A second suspension body group 22 is looped around the second drive sheave 21. The second suspension body group 22 includes at least one second suspension body 23 and at least one third suspension body 24. The second suspension body 23 has a second car end 23*a* connected to the second car suspending portion 9*e*, and a second counterweight end 23*b* connected to the second counterweight suspending portion 11*a*.

The third suspension body 24 has a third car end 24*a* connected to the third car suspending portion 9*f*, and a third counterweight end 24*b* connected to the second counterweight suspending portion 11*a*. That is, the second car 9 and the second counterweight 11 are suspended within the hoistway 1 by the second suspension body group 22 according to the 1:1 roping arrangement.

A second deflector pulley 25 for leading the second suspension body 23 to the second car suspending portion 9*e*, and a second looping angle adjusting pulley 26 for increasing the looping angle of the second suspension body 23 with respect to the second drive sheave 21 are disposed in the upper portion within the hoistway 1. The second looping angle adjusting pulley 26 is disposed between the second drive sheave 21 and the second deflector pulley 25.

The second deflector pulley 25 and the second looping angle adjusting pulley 26 are disposed such that rotary shafts thereof extend parallel to the rotary shaft of the second drive sheave 21. The third suspension body 24 is looped only around the second drive sheave 21.

Employed as each of the first suspension bodies 16, the second suspension body 23, and the third suspension body 24 is, for example, a rope having a circular cross-section or a belt-shaped rope. Employed as the rope is, for example, a steel rope made of a steel strand only or a resin-coated rope made of a steel strand having an outer periphery coated with resin.

Each of the components regarding the first suspension body group 15 (first counterweight 10, first hoisting machine 12, first deflector pulley 17, first looping angle adjusting pulley 18, and the like) and a corresponding one of the components regarding the second suspension body group 22 (second counterweight 11, second hoisting machine 19, second deflector pulley 25, second looping angle adjusting pulley 26, and the like) are disposed offset from each other in the longitudinal direction of the cars 8 and 9.

The hoisting machines 12 and 19, the deflector pulleys 17 and 25, and the looping angle adjusting pulleys 18 and 26 are supported and united by a support frame (not shown) fixed in the upper portion within the hoistway 1. The support frame is fixed to, for example, at least one of upper portions of the guide rails 2 to 7. Alternatively, the support frame may be supported by a support beam provided in an architectural structure. In addition, the hoisting machines 12 and 19, the deflector pulleys 17 and 25, and the looping angle adjusting pulleys 18 and 26 are disposed so as to intersect with the same horizontal plane. That is, the hoisting machines 12 and 19, the deflector pulleys 17 and 25, and the looping angle adjusting pulleys 18 and 26 are disposed so as to be located at least partially within the same height region.

In the elevator apparatus constructed as described above, the first looping angle adjusting pulley 18 is provided between the first drive sheave 14 and the first deflector pulley 17, and the second looping angle adjusting pulley 26 is provided between the second drive sheave 21 and the second deflector pulley 25. It is therefore possible to sufficiently secure respective looping angles of the suspension bodies 16 and 23 with respect to the drive sheaves 14 and 21 without the necessity to dispose each of the hoisting machines 12 and 19 and a corresponding one of the deflector pulleys 17 and 25 vertically apart from each other by a great distance. As a result, it is possible to reduce the vertical space for installing the hoisting machines 12 and 19 and the deflector pulleys 17 and 25. Accordingly, it is possible to efficiently dispose the hoisting machines 12 and 19 and the groups of the pulleys in the upper portion of the hoistway 1 and hence achieve a reduction in installation space.

In the foregoing example, the hoisting machines 12 and 19 are disposed identically in orientation. However, the hoisting machines 12 and 19 may be disposed reversely in orientation to each other. The hoisting machines 12 and 19 may also be disposed substantially symmetrically around each of the centers of gravity of the cars 8 and 9 on the vertical projection plane.

The first hoisting machine 12 and the first deflector pulley 17 may be changed in position. Similarly, the second hoisting machine 19 and the second deflector pulley 25 may be changed in position.

Embodiment 2

Figure 3:
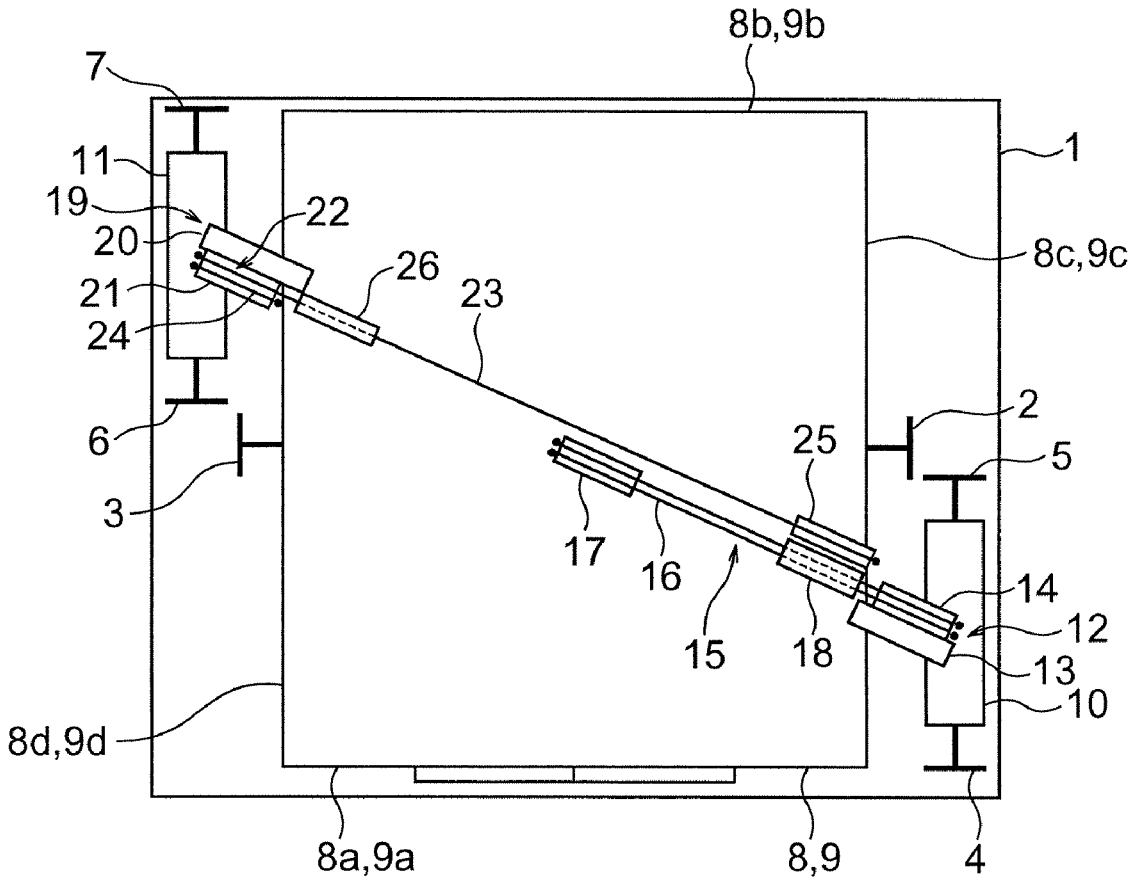
FIG. 3 is a schematic plan view showing an elevator apparatus according to Embodiment 2 of the present invention.

Reference will be made next to FIG. 3. FIG. 3 is a schematic plan view showing an elevator apparatus according to Embodiment 2 of the present invention. Referring to FIG. 3, the drive sheaves 14 and 21, the deflector pulleys 17 and 25, and the looping angle adjusting pulleys 18 and 26 are disposed such that the rotary shafts thereof extend horizontally and diagonally to the longitudinal direction of the cars 8 and 9. Embodiment 2 of the present invention is identical to Embodiment 1 of the present invention in other constructional details.

The elevator apparatus constructed as described above makes it possible to suspend the cars 8 and 9 at positions closer to the centers of gravity thereof respectively in comparison with Embodiment 1 of the present invention. As a result, it is possible to raise/lower the cars 8 and 9 more stably.

Embodiment 3

Figure 4:
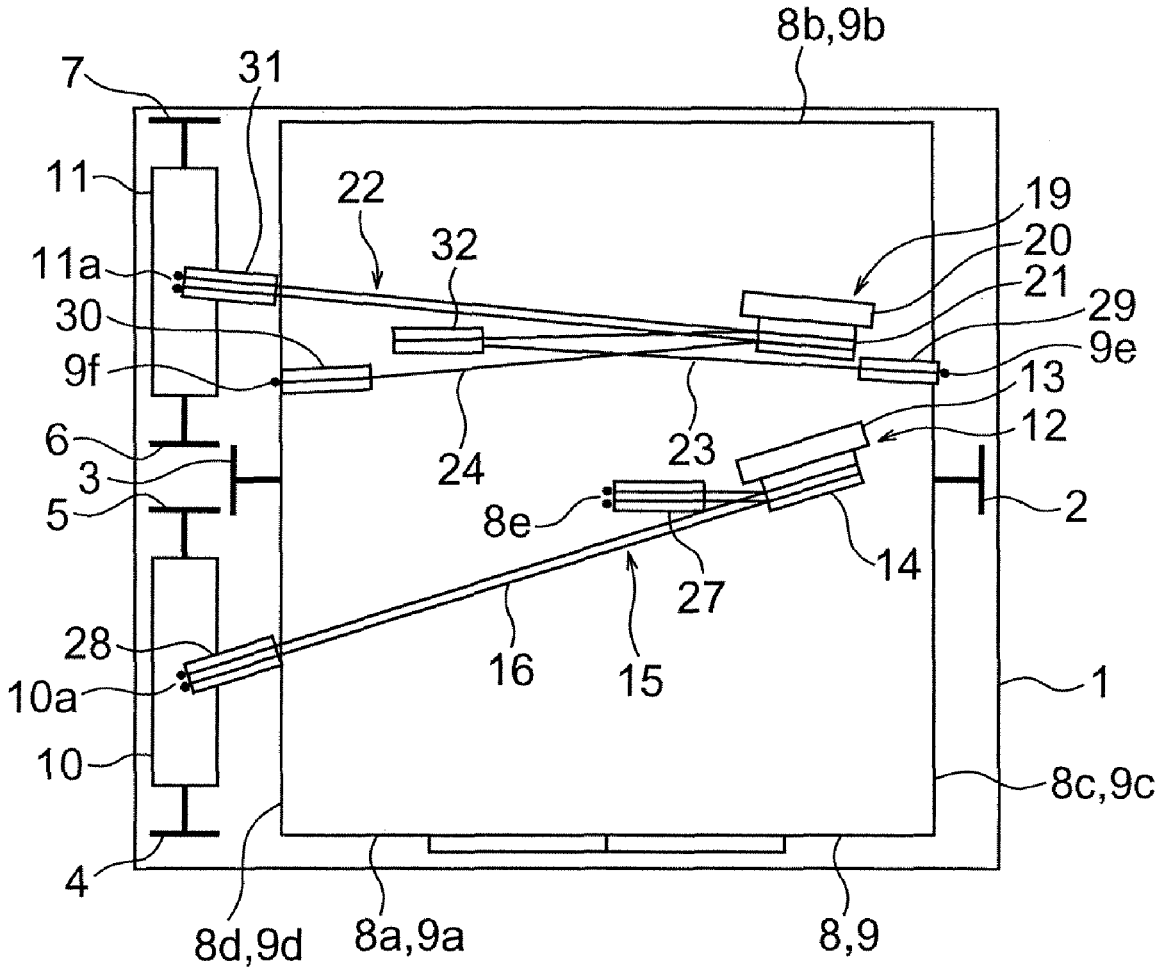
FIG. 4 is a schematic plan view showing an elevator apparatus according to Embodiment 3 of the present invention.
Figure 5:
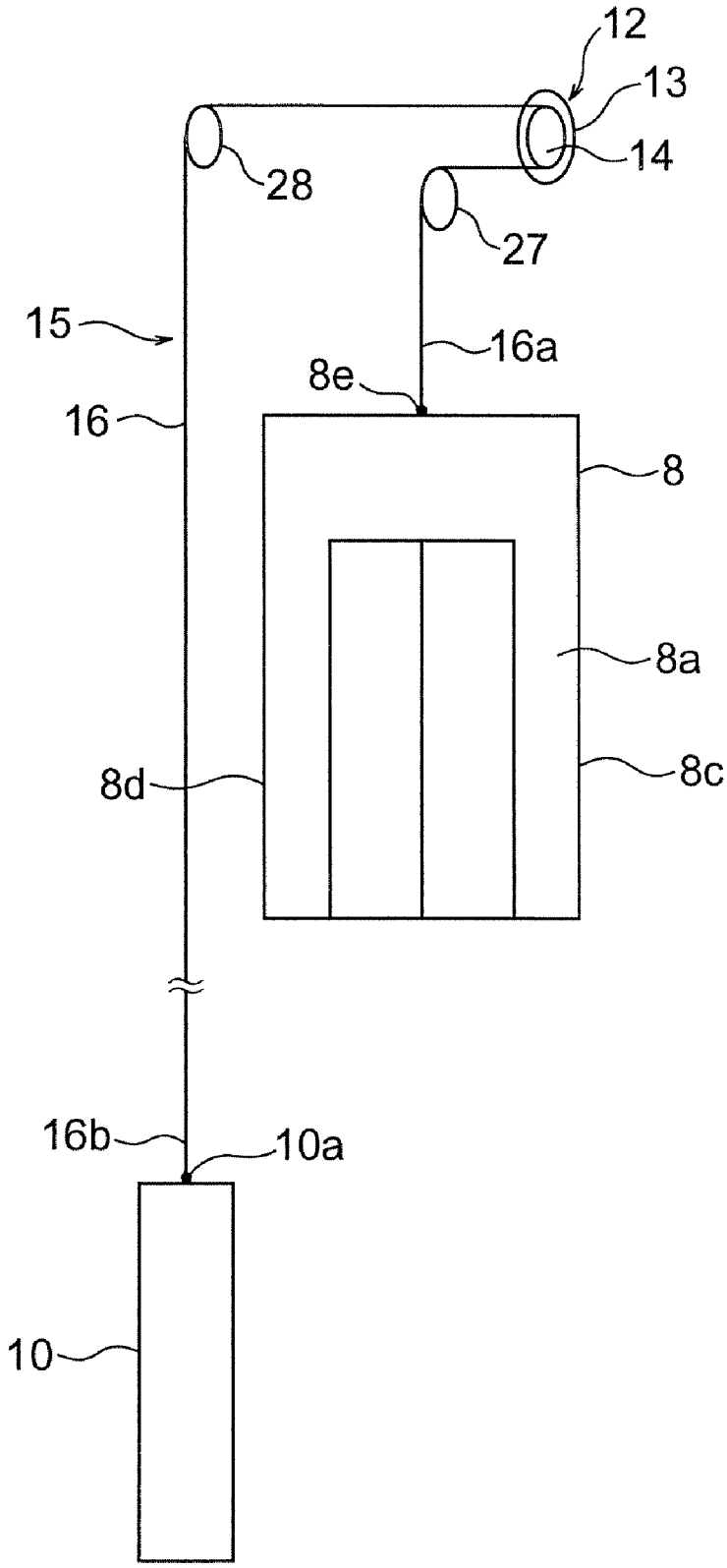
FIG. 5 is a front view showing a state in which a first car of FIG. 4 and a first counterweight of FIG. 4 are suspended.
Figure 6:
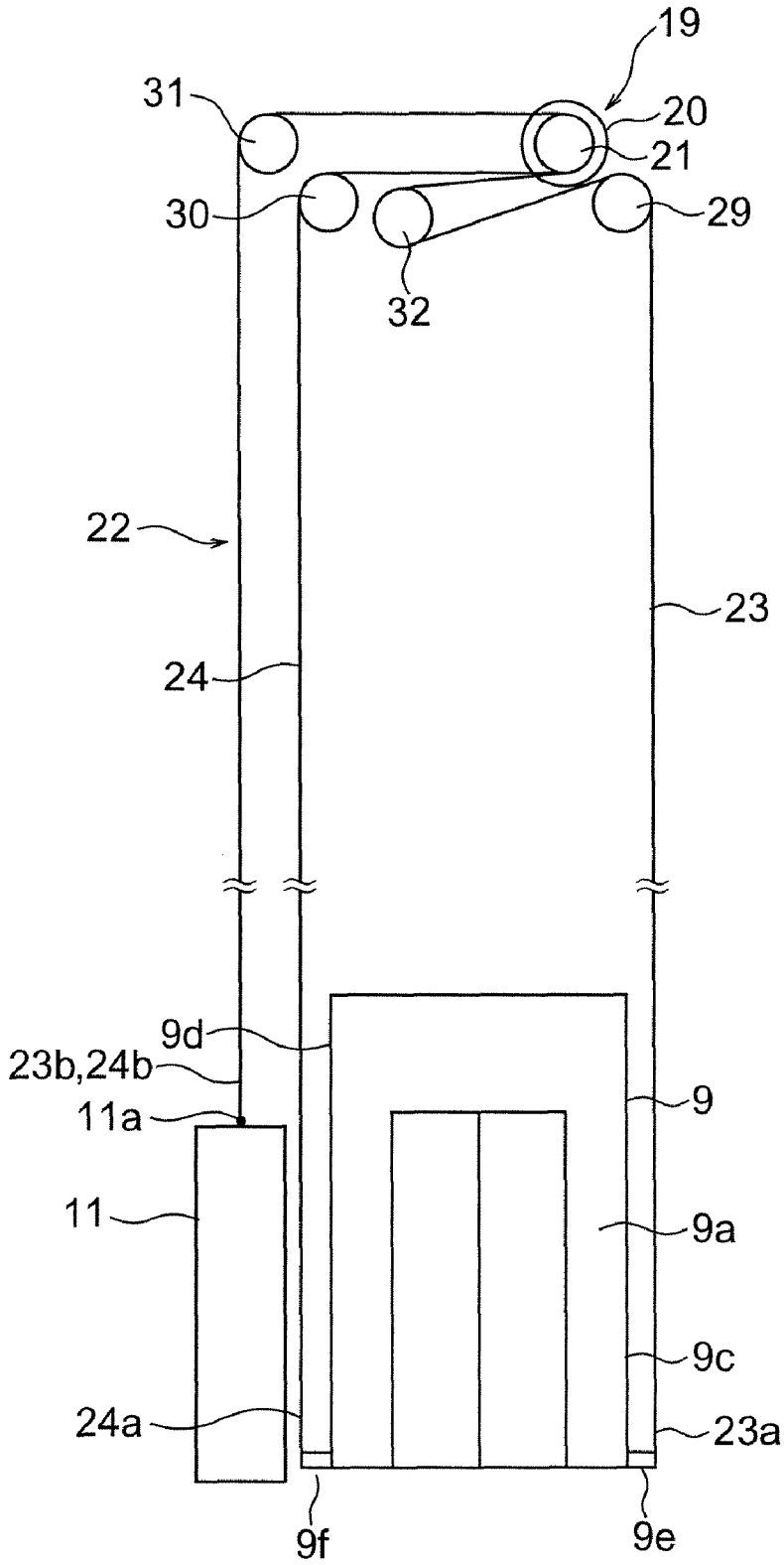
FIG. 6 is a front view showing a state in which a second car of FIG. 4 and a second counterweight of FIG. 4 are suspended.

Reference will be made next to FIGS. 4 to 6. FIG. 4 is a schematic plan view showing an elevator apparatus according to Embodiment 3 of the present invention. FIG. 5 is a front view showing a state in which the first car 8 of FIG. 4 and the first counterweight 10 of FIG. 4 are suspended. FIG. 6 is a front view showing a state in which the second car 9 of FIG. 4 and the second counterweight 11 of FIG. 4 are suspended.

Referring to FIGS. 4 to 6, the first counterweight 10 and the second counterweight 11 are disposed beside the first car 8 and the second car 9 so as to face the second lateral surfaces 8*d* and 9*d* when being located at the same height as the first car 8 and the second car 9, respectively. That is, the first counterweight 10 and the second counterweight 11 are disposed side by side in a width direction thereof.

The first hoisting machine 12, the second hoisting machine 19, a first car-side deflector pulley 27, a first counterweight-side deflector pulley 28, a second car-side deflector pulley 29, a third car-side deflector pulley 30, a second counterweight-side deflector pulley 31, and a turning pulley 32 are disposed in the upper portion within the hoistway 1. The first hoisting machine 12 and the second hoisting machine 19 are disposed above the cars 8 and 9 so as to be located as a whole within the regions of the cars 8 and 9 on the vertical projection plane.

The first car-side deflector pulley 27 is disposed above the cars 8 and 9 to lead the first suspension bodies 16 to the first car suspending portion 8*e*. The first counterweight-side deflector pulley 28 is disposed above the first counterweight 10 to lead the first suspension bodies 16 to the first counterweight suspending portion 10*a*. The second car-side deflector pulley 29 is disposed above the cars 8 and 9 to lead the second suspension body 23 to the second car suspending portion 9*e*. The third car-side deflector pulley 30 is disposed above the cars 8 and 9 to lead the third suspension body 24 to the third car suspending portion 9*f*.

The second counterweight-side deflector pulley 31 is disposed above the second counterweight 11 to lead the second suspension body 23 and the third suspension body 24 to the second counterweight suspending portion 11*a*. The turning pulley 32 reverses the orientation of the second suspension body 23 drawn out from the second drive sheave 21, and leads the second suspension body 23 to the second car-side deflector pulley 29. The deflector pulleys 27 to 31 and the turning pulley 32 are disposed such that rotary shafts thereof extend horizontally.

The hoisting machines 12 and 19, the deflector pulleys 27 and 31, and the turning pulley 32 are disposed so as to intersect with the same horizontal plane. That is, the hoisting machines 12 and 19, the deflector pulleys 27 to 31, and the turning pulley 32 are disposed so as to be located at least partially within the same height region. Embodiment 3 of the present invention is identical to Embodiment 1 of the present invention in other constructional details.

The elevator apparatus constructed as described above also makes it possible to efficiently dispose the hoisting machines 12 and 19 and the groups of the pulleys in the upper portion of the hoistway 1 and hence achieve a reduction in installation space.

In each of the foregoing examples, the low-profile hoisting machine is illustrated as each of the first hoisting machine 12 and the second hoisting machine 19. However, a hoisting machine that is larger in dimension in an axial direction thereof than in a direction perpendicular to the axial direction may be employed instead.

Embodiment 4

Figure 7:
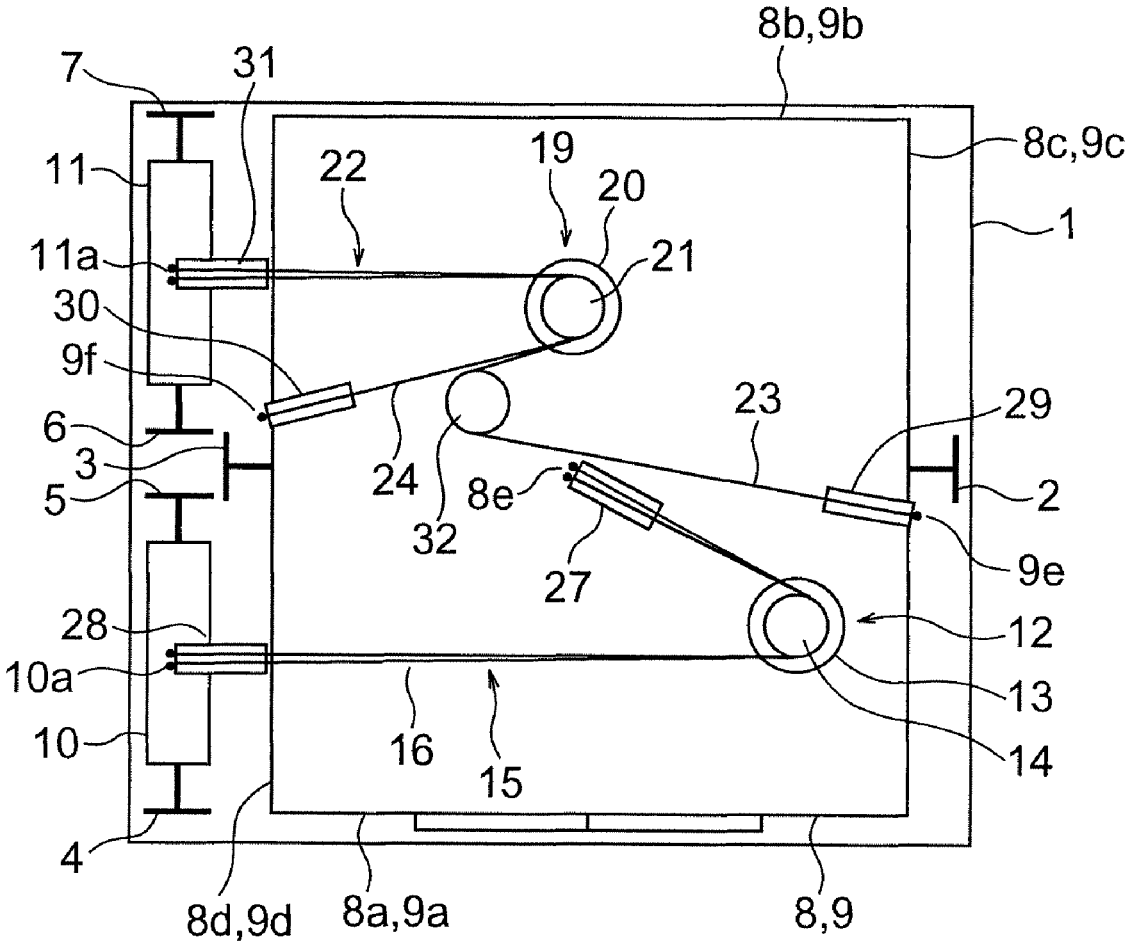
FIG. 7 is a schematic plan view showing an elevator apparatus according to Embodiment 4 of the present invention.
Figure 8:
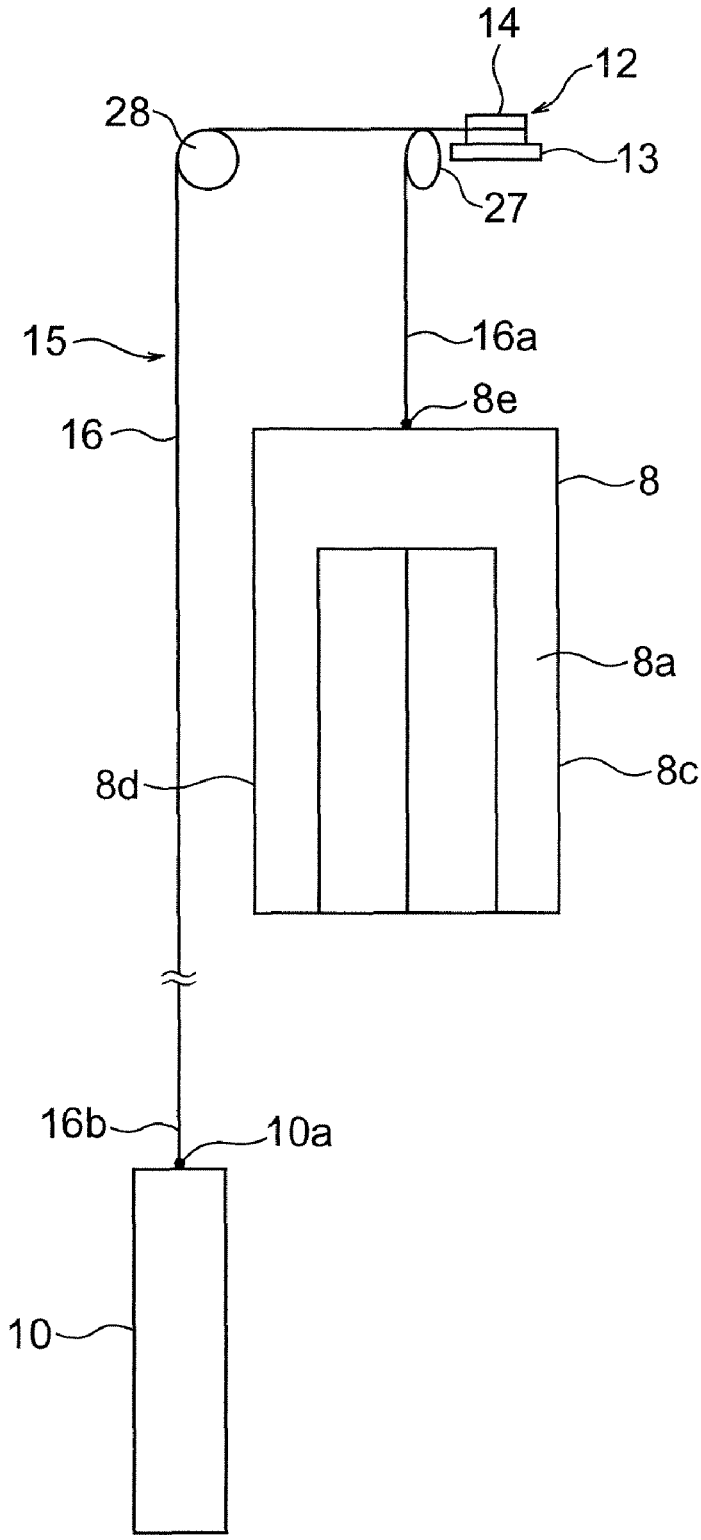
FIG. 8 is a front view showing a state in which a first car of FIG. 7 and a first counterweight of FIG. 7 are suspended.
Figure 9:
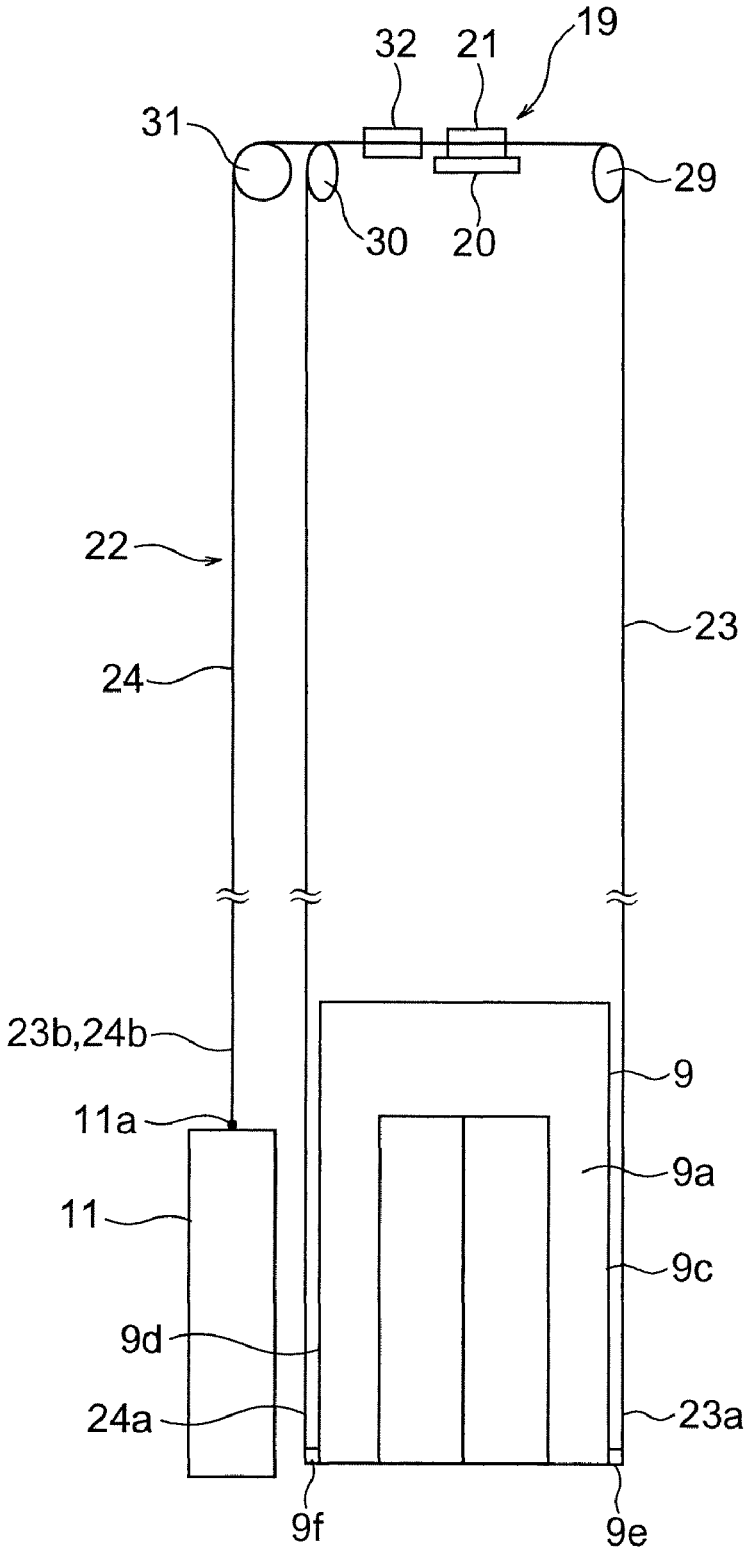
FIG. 9 is a front view showing a state in which a second car of FIG. 7 and a second counterweight of FIG. 7 are suspended.

Reference will be made next to FIGS. 7 to 9. FIG. 7 is a schematic plan view showing an elevator apparatus according to Embodiment 4 of the present invention. FIG. 8 is a front view showing a state in which the first car 8 of FIG. 7 and the first counterweight 10 of FIG. 7 are suspended. FIG. 9 is a front view showing a state in which the second car 9 of FIG. 7 and the second counterweight 11 of FIG. 7 are suspended.

Referring to FIGS. 7 to 9, the first hoisting machine 12 and the second hoisting machine 19 are disposed such that the rotary shafts of the drive sheaves 14 and 21 extend vertically. Accordingly, the turning pulley 32 is disposed such that the rotary shaft thereof extends substantially vertically, namely, slightly slantingly with respect to the vertical direction. Embodiment 4 of the present invention is identical to Embodiment 3 of the present invention in other constructional details.

The elevator apparatus constructed as described above also makes it possible to efficiently dispose the hoisting machines 12 and 19 and the groups of the pulleys in the upper portion of the hoistway 1 and hence achieve a reduction in installation space.

In each of the foregoing examples, the two cars 8 and 9 are provided within the common hoistway 1. However, three or more cars may be provided therewithin.

In each of the foregoing examples, the second car suspending portion 9*e* and the third car suspending portion 9*f* are provided at the lower ends of the first lateral surface 9*c* and the second lateral surface 9*d* of the second car 9, respectively. However, the second car suspending portion 9*e* and the third car suspending portion 9*f* may be provided at upper ends or intermediate portions of the first lateral surface 9*c* and the second lateral surface 9*d* of the second car 9, respectively.

The invention claimed is:

1. An elevator apparatus comprising:

a first hoisting machine having a first drive sheave and disposed in an upper portion of a hoistway such that a rotary shaft of the first drive sheave extends horizontally;

a first car and a first counterweight that are raised and lowered within the hoistway by the first hoisting machine;

a first suspension body having a first car end connected to an upper portion of the first car and a first counterweight end connected to the first counterweight, and looped around the first drive sheave;

a second hoisting machine having a second drive sheave and disposed in the upper portion of the hoistway such that a rotary shaft of the second drive sheave extends horizontally;

a second car, disposed below the first car and having a first lateral surface and a second lateral surface that face each other, for being raised and lowered within the hoistway by the second hoisting machine;

a second counterweight that is raised and lowered within the hoistway by the second hoisting machine;

a second suspension body having a second car end connected to the second car on the first lateral surface side thereof and a second counterweight end connected to the second counterweight, and looped around the second drive sheave;

a third suspension body having a third car end connected to the second car on the second lateral surface side thereof and a third counterweight end connected to the second counterweight, and looped around the second drive sheave;

a first deflector pulley disposed in the upper portion of the hoistway and having the first suspension body looped therearound; and a second deflector pulley disposed in the upper portion of the hoistway and having the second suspension body looped therearound, where in the hoistway has, disposed in the upper portion thereof, a looping angle adjusting pulley having the second suspension body looped therearound between the second drive sheave and the second deflector pulley to increase a looping angle of the second suspension body with respect to the second drive sheave.

2. The elevator apparatus according to claim 1, wherein:

the hoistway has, disposed in the upper portion thereof, another looping angle adjusting pulley having the first suspension body looped therearound between the first drive sheave and the first deflector pulley.

3. The elevator apparatus according to claim 1, wherein:

the first counterweight is disposed beside the first car and the second car so as to face the first lateral surface when being located as high as the second car; and the second counterweight is disposed beside the first car and the second car on an opposite side of the first counterweight so as to face the second lateral surface when being located as high as the second car.

4. The elevator apparatus according to claim 3, wherein:

the first counterweight is disposed offset from each of longitudinal centers of the first car and the second car; and the second counterweight is disposed offset from each of the longitudinal centers of the first car and the second car on the opposite side of the first counterweight.

5. The elevator apparatus according to claim 1, wherein:

the first hoisting machine is disposed above the first counterweight so as to overlap with the first counterweight on a vertical projection plane; and the second hoisting machine is disposed above the second counterweight so as to overlap with the second counterweight on the vertical projection plane.

6. The elevator apparatus according to claim 1, wherein the first hoisting machine and the second hoisting machine are disposed such that rotary shafts of the first drive sheave and the second drive sheave extend parallel to each other.

7. The elevator apparatus according to claim 1, wherein the first hoisting machine, the second hoisting machine, the first deflector pulley, the second deflector pulley, and the looping angle adjusting pulley are disposed so as to intersect with a single horizontal plane.

* * * * *